United States Patent [19]

Shank

[11] 3,941,501

[45] Mar. 2, 1976

[54] DIFFUSER INCLUDING A ROTARY STAGE

[75] Inventor: Wayne C. Shank, Tucson, Ariz.

[73] Assignee: Avco Corporation, Williamsport, Pa.

[22] Filed: Nov. 18, 1974

[21] Appl. No.: 524,358

[52] U.S. Cl. ..... 415/147; 415/211; 415/219 A

[51] Int. Cl.[2] ..... F01D 13/02

[58] Field of Search ..... 415/147, 211; 416/244 A

[56] References Cited

UNITED STATES PATENTS

| | | | |
|---|---|---|---|
| 1,034,184 | 7/1912 | Alberger | 415/147 |
| 2,967,013 | 1/1961 | Dallenbach et al. | 415/219 A |
| 3,460,748 | 8/1969 | Erwin | 415/219 A |

FOREIGN PATENTS OR APPLICATIONS

| | | | |
|---|---|---|---|
| 931,344 | 10/1947 | France | 415/147 |
| 279 | 1910 | United Kingdom | 415/146 |
| 154,071 | 11/1920 | United Kingdom | 416/244 A |
| 41,650 | 8/1907 | Switzerland | 415/147 |
| 137,013 | 5/1960 | U.S.S.R. | 415/147 |

*Primary Examiner*—Henry F. Raduazo
*Attorney, Agent, or Firm*—Charles M. Hogan; Irwin P. Garfinkle

[57] ABSTRACT

A two-stage diffuser is disclosed which is intended to be used with a high pressure ratio centrifugal compressor. The first stage comprises a vaneless diffuser passage having rotating sidewalls that freely turn on bearings mounted coaxially with the compressor rotor. The second stage comprises a stationary vaned-type diffuser. In combination, the two stages provide a compact diffuser having improved efficiency. Gas flow leaving the compressor from the periphery of the impeller at supersonic speed contacts the moving sidewalls of the rotary diffuser stage. By having these walls travel at nearly half the speed of the impeller, relative difference in speed between the gas and the walls is subsonic, hence, no shock wave occurs. Expansion of the gas in the first rotary diffuser stage makes it possible to deliver subsonic gas to the vaned second stage.

6 Claims, 2 Drawing Figures

DIFFUSER INCLUDING A ROTARY STAGE

BACKGROUND OF THE INVENTION

This invention relates to improvements in diffusers used with centrifugal compressors. Of particular concern are the diffusers and compressors used in gas turbine engines of small to medium size. In these engines, it is common practice to configure a high pressure ratio compressor which delivers a compressible fluid, usually air, at high velocity to a diffuser wherein the fluid is decelerated to produce a pressure rise.

Many different types of diffusers have been built over the last 50 years. U.S. Pat. No. 2,157,0002 is an example of an early diffuser. French Pat. No. 977,357 shows a double walled rotary diffuser wherein both side walls are supported on bearings mounted on the hollow shaft which drives the rotor. Friction transmitted via the bearing race helps to drive the French rotary diffuser. U.S. Pat. No. 3,460,748 discloses a compressor having disks which extend radially beyond the compressor blades to form a rotating vaneless diffuser passage which is followed by a vaned stationary diffuser. However, since the rotary vaneless section in U.S. Pat. No. 3,460,748 has walls which are integral with the blades of the compressor, they will be traveling at the same speed as the compressor. As a result, the periphery of the rotary diffuser section is traveling at high speed with respect to the stationary vaned second stage.

The present invention solves this problem by utilizing a rotating vaneless stage which turns at a fraction of the speed of the compressor rotor. Energy to turn the rotary stage comes from three sources. First, driving torque for the rotating diffuser element comes from bearing and oil film friction between the rotary element and the drive shaft of the compressor. Second, gas molecules striking the walls of the rotary diffuser section at an angle impart a torque couple force. Third, air striking the struts which connect one sidewall with the other imparts a driving force until the design speed of rotation is reached. As a result, a diffuser built according to the invention enables one to efficiently match a compressor rotor delivering gas at supersonic velocity to a stationary diffuser by introduction of a rotating stage having sidewalls which travel at a speed which is in a range that is approximately midway between that of the periphery of the impeller and the stationary vanes of the diffuser second stage.

SUMMARY OF THE INVENTION

This invention pertains to a diffuser which has two stages. There is first a rotary vaneless inner stage which closely surrounds the periphery of the impeller of a centrifugal compressor. The rotary stage is circumferentially surrounded by a second vaned-type stationary diffuser stage. Both stages are configured to lie in radial alignment with the impeller rotor of the compressor. At the output of the vaned second stage of the diffuser, there is an annulus which collects the compressed gas and redirects it along the length of the engine coaxially with respect to the turbine drive shaft.

The rotary first stage of the diffuser is configured so that gas delivered radially outward from the compressor impeller passes between sidewalls which are both parallel and rotating. Speed of rotation is an appreciable fraction of that of the impeller. The rotating sidewalls consist of two disks connected together at the periphery by a mulitplicity of struts. The disk on the upstream side of the compressor impeller is ring shaped with an inner diameter that closely surrounds the periphery of the impeller. The disk on the downstream side of the impeller extends all the way outward from a support hub mounted on the axial shaft. As such, it serves both as one sidewall of the rotary first stage of the diffuser and as the downstream end wall of the compressor. The ring shaped disk on the upstream side is physically connected to the axis mounted disk on the downstream side by a multiplicity of small struts. These struts are of streamlined cross section and also serve to properly space the distance between the two disks.

The disk assembly making up the rotary diffuser stage is free to turn on the shaft which drives the compressor. Bearing and oil film friction provide some energy for turning. Additional torque comes from the gas flow coming from the impeller. This gas, leaving the periphery of the impeller in a generally tangential direction, strikes the sidewalls of the vaneless diffuser section in such a way as to cause the assembly to turn.

Properly configured, the rotary diffuser stage can be made to rotate at about 40 percent of the speed of the impeller. As a result, even under full load conditions, the relative velocity between the gas molecules leaving the impeller and the sidewalls remains at subsonic levels. This accomplishes two things. First, it prevents the formation of efficiency robbing shock waves. Second, it helps to impart a more radially outward trajectory to those gas molecules which were closest to the front and back shrouds of the impeller. These wall-clinging gas molecules actually leave the impeller at a rather low velocity even though those in midstream are traveling supersonic. As a result, the slow gas molecules which strike the sidewalls of the rotary diffuser stage are given an accelerative boost. The result is that there is imparted to the gas stream coming from the impeller a sort of smoothing function. The low velocity molecules which leave the impeller at an angle almost tangent with the periphery are speeded up and given a radially outward acceleration. Those gas molecules leaving at a high angle and at supersonic velocity are slowed down as they penetrate into the expanding volume of the diffuser.

The vanes second stage can thus be configured so that the central axis of each passage is more nearly radial than would be the case for a configuration where only a stationary vaned diffuser was used. The net result is that use of the two-stage concept enables one to build a compact and efficient diffuser.

BRIEF DESCRIPTION OF THE DRAWINGS

Having generally described the invention, the accompanying drawings are shown by way of illustration of a preferred embodiment thereof, in which.

DESCRIPTION OF THE PREFERRED EMBODIMENT

Figure 1:
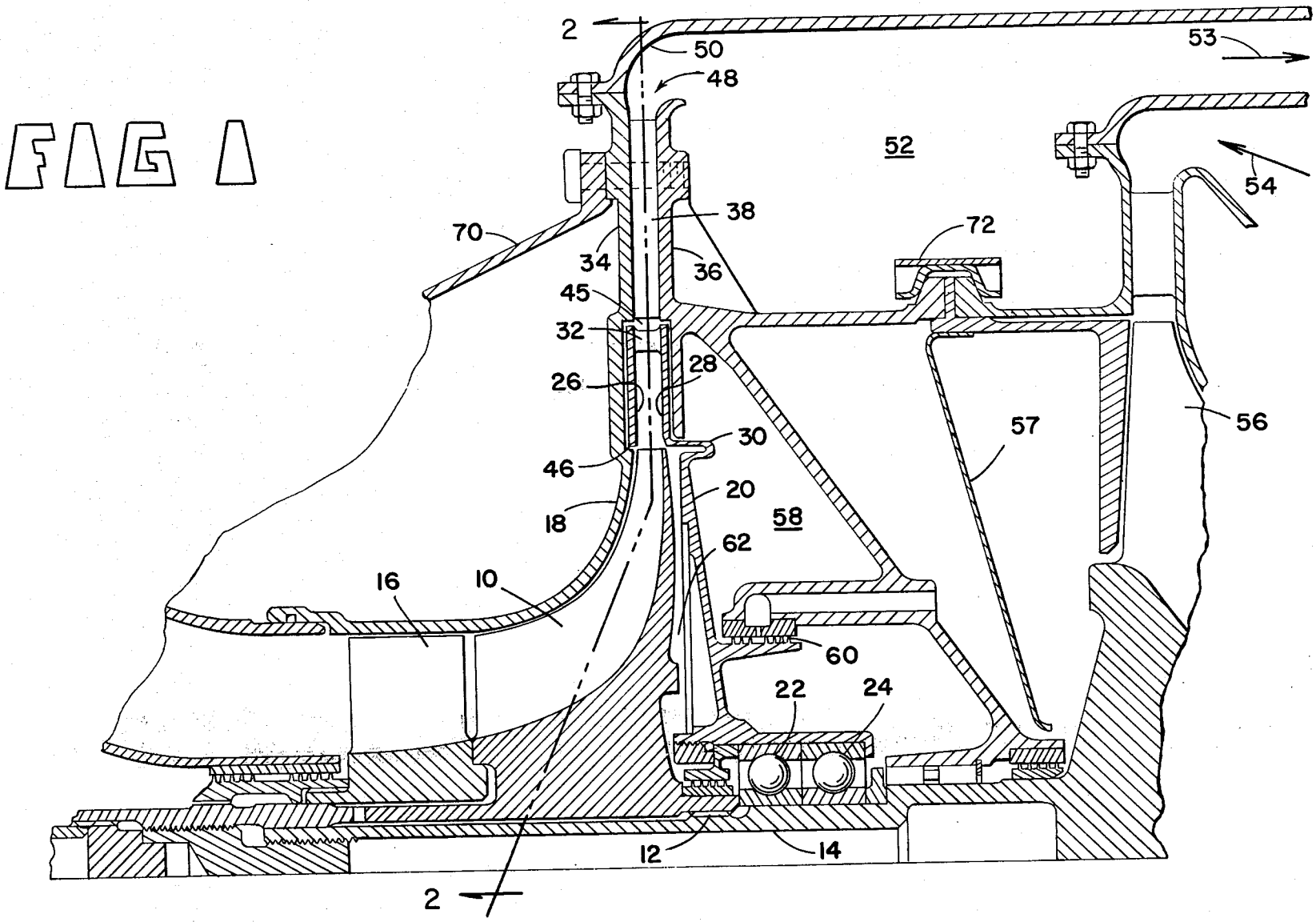
FIG. 1 shows, in part, the longitudinal cross section of the arrangement of the compressor, the diffuser and one stage of the gas turbine when constructed in accordance with the invention.

In FIG. 1 there is shown a centrifugal impeller rotor 10 keyed via spline teeth 12 to driving shaft 14. The impeller may form part of an aircraft engine compressor and, in FIG. 1, it is shown as succeeding an axial compressor having blade 16. Circumferentially surrounding the impeller rotor is an exterior housing member 18. Housing member 18 extends radially beyond the impeller rotor such that it forms forward annular end plate 34 of a diffuser which completely surrounds the periphery of the impeller.

The diffuser consists of two stages, a rotary first stage mounted within recesses in the forward and rear annular end plates and a vaned second stage that remains stationary. The rotating stage is vaneless and slightly expanding. Its main function is to provide boundary layer control in that fluid from the impeller strikes rotating walls. Thus, fluid coming from impeller rotor 10 in a generally tangential direction will pass between rotating sidewalls 26 and 28. Sidewall 28 is integral with and forms one face of disk 20. Disk 20 mounts via bearing races 22 and 24 directly on driving shaft 14. Elastic web 30 connects the outer part of the disk which forms sidewall 28 with the axially supported portion of disk 20. The opposite sidewall 26 is formed from a ring-shaped disk member which mounts via a multiplicity of struts 32 to the axially supported disk 20. Elastic web 30 serves to keep the rotating diffuser stage rotating in a plane perpendicular to the axis of shaft 14 even though the speed of the rotary diffuser stage exceeds 10,000 rpm.

Figure 2:
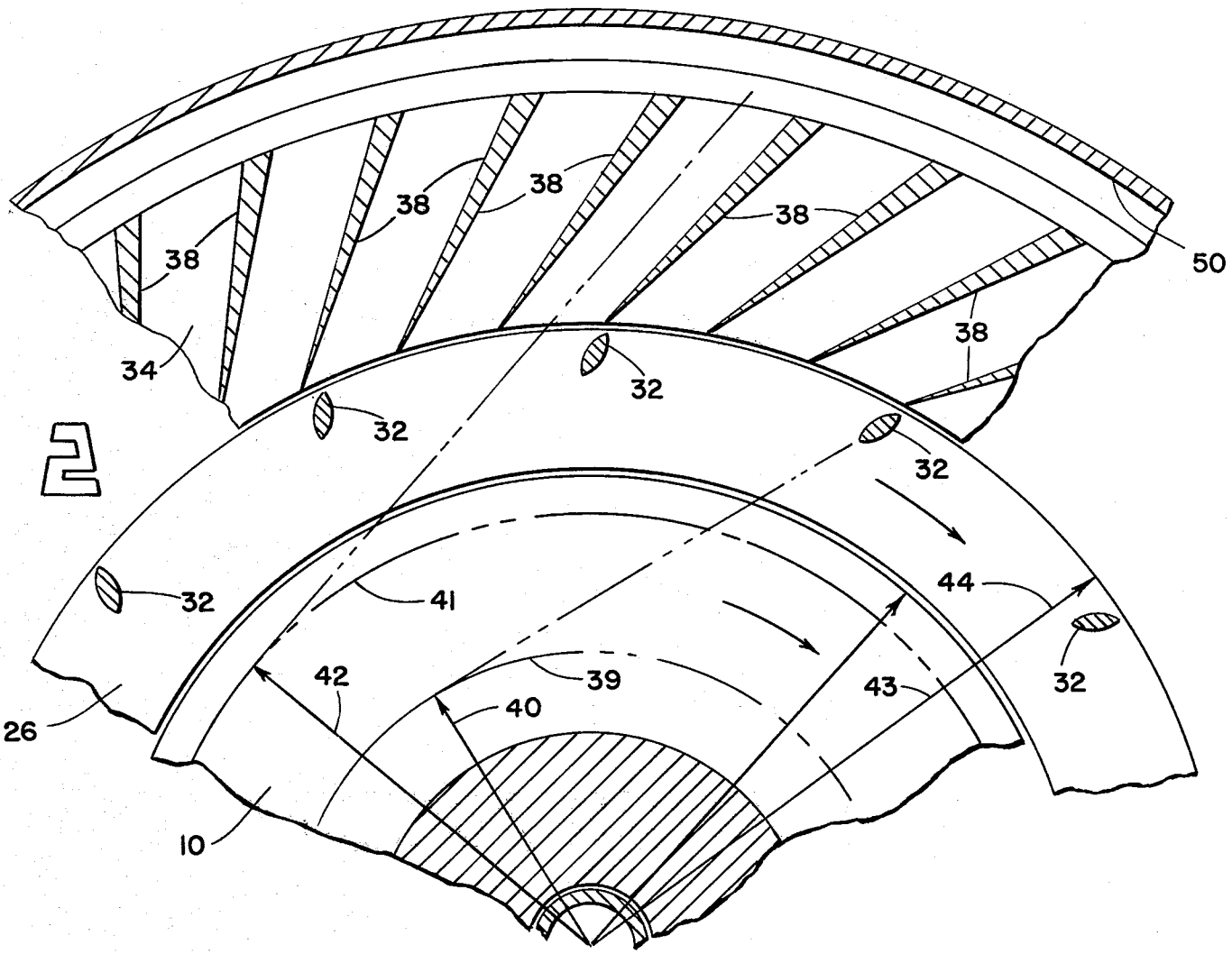
FIG. 2 is a cross section along line 2—2 of FIG. 1.

Compressible fluid leaving the rotary vaneless first stage enters into a plurality of passages comprising forward annular end plate 34, rear annular end plate 36 and a multiplicity of vanes 38 (see FIG. 1). FIG. 2 shows a cross-sectional view of the diffuser and its relation to the impeller.

As seen in FIG. 2, impeller 10 is closely surrounded by rotary diffuser sidewall 26. The circular section of the disk having face 26 is supported by means of a multiplicity of struts 32 to bearing supported disk 20. Struts 32 are of thin cross section and have their major cross-sectional axis arranged so as to be tangent to a common circle 39 whose radius 40 is a specified fraction of the outside radius 43 of impeller 10. Struts 32 can be of small cross section because the rotary diffuser stage is free running and, hence, has very gradual acceleration and deceleration forces present. Further, as the speed of revolution increases, both disks tend to expand equally due to the presence of elastic web 30 (shown in FIG. 1).

Compressible fluid leaves the rotary diffuser stage and enters the passages of the stationary diffuser stage. Wedge-shaped vanes 38 serve to define the passageways between the forward and rear walls of the diffuser. The orientation of vanes 38 are such that they form passages whose centerlines are tangential to a common circle 41 whose radius is less than the radius 43 of the impeller.

Vanes 38 can be at a more nearly radial pointing angle than would be the case for a vaned diffuser of conventional design. This is because the rotary diffuser stage tends to impart an outward bending moment to the flow of gas. Calculation shows that for the case where the outer radius 44 of the rotary diffuser stage is 1.35 times that of the radius of impeller 43, a gas exit angle of about 15° above tangential is achieve from an impeller having a rotative speed of 45,000 rpm.

Returning now to FIG. 1, pressure at the periphery of the rotary diffuser (zone 45) will be higher than at the output of the impeller (zone 46) due to the action of the diffuser. This pressure difference assures that there will be an air bearing along the outside wall of the ring disk having sidewall 26. Pressure from zone 45 will also leak along the outside wall of disk 20 into plenum 58.

On the impeller side of disk 20 (zone 62), operating pressure will be below that in plenum 58. This is beneficial in that the air pressure in plenum 58 will help to correct any tendency of disk 20 to cup, to the right as viewed in FIG. 1, due to the outward expansion of the ring-shaped disk supported by means of struts 32.

Rotary seal 60 prevents leakage of pressure from plenum 58 into other parts of the engine. Seal 60 is kept at a small radius to minimize wear and leakage.

Gas from the vaned second stage of the diffuser is collected in annulus 48. The curved external engine shroud 50 directs the high pressure gas into plenum 52. From there it passes via ducting 53 to a combustion chamber, not shown. Hot gas 54 from the combustion chamber drives turbine blades 56. Heat shield 57 serves to protect the compressor and diffuser sections and, at the same time, serves to insulate and maintain lubricant temperatures at reasonable levels near the drive shaft.

Structural members 70 and 72 help support the engine and serve as mounts for various other units.

It is to be understood that the invention is not limited to the specific embodiment illustrated in the accompanying drawings. Changes in dimensional ratios may be required as the capacity of the diffuser is matched to a particular turbine. Bearings and seals can also be varied without departing from the spirit of the invention. The number and dimensions of the passages in the stationary diffuser stage can likewise be varied to suit design requirements.

It will be further understood that the diffuser configuration disclosed, while presently shown in cooperative arrangement with a centrifugal compressor, could function equally well in diffusing fluid flow from other devices wherein velocities range from subsonic to supersonic.

I claim:

1. In a centrifugal compressor of the type having a shaft-driven rotary radial-flow impeller for delivering compressible gas at a supersonic velocity, a multistage diffuser comprising:

a rotary stage having a pair of annular axially spaced front and back walls, each of said walls having an inner and an outer circumference, said inner circumference closely surrounding said impeller, the annular space between said walls defining a vaneless flow passage for receiving gas radially discharged from said impeller, means for rotating said rotary stage concentric with said impeller, said means comprising a disk rotatably supported on said impeller shaft, an elastic web interconnecting said disk with the back wall of said rotary stage, said web being positioned at a radius approximately equal to the radius of said impeller, and means for supporting the front wall of said rotary stage from said back wall, said means comprising a multiplicity of equi-angularly spaced struts of streamlined cross section connected between said walls at the outer peripheries thereof; and a fixed stage having a pair of axially spaced front and back walls, said walls having an inner periphery closely surrounding the outer periphery of said rotary stage, and having a plurality of symmetrically arranged vanes mounted between said spaced walls of said fixed stage; the annular space between said walls and said vanes defining flow passages for receiving gas discharged by said rotary stage.

2. The invention as defined in claim 1 wherein said impeller is provided with front and back shrouds and wherein said front and back walls of said rotary stage are aligned with said front and back shrouds, respectively.

3. The invention as defined in claim 2 wherein the front wall of said fixed stage is integral with the front shroud of said impeller.

4. The invention as defined in claim 3 wherein the surface of said integral wall and shroud is recessed, and wherein the front wall of said rotary stage is rotatable within said recess, whereby said front shroud and the front walls of said fixed and rotary stages are in a single plane.

5. The invention as defined in claim 1 wherein the magnitude of the outside diameter of said rotary stage is approximately equal to 1.3 times the diameter of the periphery of said impeller.

6. The invention as defined in claim 1 wherein each of said vanes comprises a wedge at its radial inward end.

* * * * *